US012201210B2

(12) United States Patent
Xu

(10) Patent No.: US 12,201,210 B2
(45) Date of Patent: Jan. 21, 2025

(54) COSMETIC BRUSH CLEANING DEVICE

(71) Applicant: Yang Xu, Guangdong (CN)

(72) Inventor: Yang Xu, Guangdong (CN)

( * ) Notice: Subject to any disclaimer, the term of this patent is extended or adjusted under 35 U.S.C. 154(b) by 276 days.

(21) Appl. No.: 17/777,920

(22) PCT Filed: Nov. 19, 2020

(86) PCT No.: PCT/CN2020/129928
§ 371 (c)(1),
(2) Date: May 18, 2022

(87) PCT Pub. No.: WO2021/098746
PCT Pub. Date: May 27, 2021

(65) Prior Publication Data

US 2023/0027910 A1 Jan. 26, 2023

(30) Foreign Application Priority Data

Nov. 19, 2019 (CN) ..... 201922002010.X

(51) Int. Cl.
*A46B 17/06* (2006.01)
*A46B 9/02* (2006.01)
(Continued)

(52) U.S. Cl.
CPC ..... *A46B 17/06* (2013.01); *A46B 9/026* (2013.01); *A46B 13/02* (2013.01);
(Continued)

(58) Field of Classification Search
CPC ..... A46B 17/06; A46B 2200/3073; A46B 15/0051; A46B 13/02; A46B 9/026; A46D 1/0207
(Continued)

(56) References Cited

U.S. PATENT DOCUMENTS 9,380,860 B1 * 7/2016 Taylor ..... A46B 17/06
9,380,861 B1 * 7/2016 Newman ..... A47B 37/04
(Continued)

FOREIGN PATENT DOCUMENTS

CN 106073144 11/2016
CN 208343804 U 1/2019
(Continued)

OTHER PUBLICATIONS

International Search Report issued for International Patent Application No. PCT/CN2020/129928, Date of mailing: Feb. 22, 2021, 6 pages including English translation.
(Continued)

*Primary Examiner* — Katina N. Henson
(74) *Attorney, Agent, or Firm* — HSML P.C.

(57) ABSTRACT

A cosmetic brush cleaning device, comprising a support part (1) and a cleaning part (2). The support part (1) and the cleaning part (2) form a hourglass-shaped structure; and the cleaning part (2) is rotationally arranged at the top of the support part (1). The cleaning device can perform the action of back-and-forth friction between bristles and a silica gel inner rotary disc (22) in an electric manner, the cleaning efficiency is effectively improved, the cleaning effect can be effectively enhanced, the tedious manual back-and-forth movement is greatly reduced, and the problem that time and labor are wasted when a cosmetic brush is manually cleaned is solved.

13 Claims, 7 Drawing Sheets

(51) Int. Cl.
*A46B 13/02* (2006.01)
*A46B 15/00* (2006.01)
*A46D 1/00* (2006.01)

(52) U.S. Cl.
CPC ..... *A46B 15/0051* (2013.01); *A46D 1/0207* (2013.01); *A46B 2200/3073* (2013.01)

(58) Field of Classification Search
USPC ..... 15/38
See application file for complete search history.

(56) References Cited

U.S. PATENT DOCUMENTS

| | | | | |
|---|---|---|---|---|
| 2014/0096801 | A1* | 4/2014 | McCormick | B08B 11/02 134/115 R |
| 2018/0264875 | A1* | 9/2018 | Mongan | B44D 3/006 |
| 2019/0021482 | A1* | 1/2019 | Premananda | B06B 1/045 |

FOREIGN PATENT DOCUMENTS

| | | |
|---|---|---|
| CN | 210672519 U | 6/2020 |
| CN | 211431473 U | 9/2020 |

OTHER PUBLICATIONS

Written Opinion issued for International Patent Application No. PCT/CN2020/129928, Date of mailing: Feb. 22, 2021, 8 pages including partial English machine translation.

* cited by examiner

COSMETIC BRUSH CLEANING DEVICE

TECHNICAL FIELD

The present disclosure relates to the technical field of small cleaning electrical appliances, and particularly relates to a cosmetic brush cleaning device.

BACKGROUND

Under the trend of upgrading consumption, the makeup market size gradually expands, so that the use of the cosmetic brush is gradually popularized; in European and American countries, a cosmetic brush is even a necessary tool for making up. Since the cosmetic brush is in frequent contact with the skin and cosmetics, bacteria may grow on the bristles, and cosmetics, grease, and dead skin may remain on the bristles, the regular cleaning of the cosmetic brush is a necessary step for maintaining the hygiene of the bristles and the health of the skin, and ensuring the effect of the cosmetic brush. However, the regular way to clean cosmetic brushes is still quite manual, unlike that clothes are cleaned by a fully automatic washing machine, which achieves and popularizes the mechanization of clothes cleaning.

The manual cleaning method of the cosmetic brush mainly includes dipping a small amount of cleaner in the bristles, scrubbing the bristles back and forth on a silicone mat with raised dots or textures to remove the stains, and rinsing the bristles under clean water. This cleaning process is not only time-consuming, but also laborious, which makes many women lazy to clean the cosmetic brush regularly and further leads to skin problems and also reduces the normal service life of cosmetic brushes, resulting in premature replacement of the cosmetic brush, causing unnecessary waste and extra expenses, and not in line with the concept of environmental protection. Although there are some electrical appliances for mechanically cleaning cosmetic brushes in the market, the development is still not mature, and those electrical appliances still have a plurality of defects: low cleaning efficiency, poor cleaning effect, excessive volume, poor sealing, cumbersome operation, high cost, and the like. Therefore, the present disclosure proposes a cosmetic brush cleaning device to solve the above-mentioned technical problems.

SUMMARY

The technical problem to be solved by the present disclosure is to provide a cosmetic brush cleaning device that motorizes the action of manually scrubbing the bristles on the silicone inner turntable back and forth, which can effectively improve the cleaning efficiency, and effectively enhance the cleaning effect. Motorization greatly reduces the cumbersome manual back-and-forth movement, improves cleaning efficiency, and can solve the time consuming and laborious pain points of manually cleaning cosmetic brushes.

A cosmetic brush cleaning device includes a support part and a cleaning part. The support part and the cleaning part form an hourglass-shaped structure. The cleaning part is rotatably arranged at a top of the support part.

Preferably, the support part includes a support housing; a base is embedded in a bottom of the support housing.

Further preferably, the base is provided with a positioning and mounting ring on an upper end surface thereof. A geared motor is mounted in the positioning and mounting ring. It is convenient for the positioning and mounting of the geared motor, thereby improving the production efficiency.

Further preferably, the support housing is provided with a mounting hole and screw holes at a top end thereof. The screw holes are symmetrically arranged on two sides of the mounting hole. Fixing screws are threadedly connected in the screw holes. It is convenient to fix the geared motor.

Further preferably, the fixing screws are in threaded connection with the geared motor through the screw holes. A rotating shaft of the geared motor extends out of the top end of the support housing through the mounting hole.

Preferably, the cleaning part includes an outer turntable; a mounting nut is provided inside the outer turntable. A rotating shaft of the geared motor extends through a bottom of the outer turntable, and the bottom of the outer turntable is fixedly connected through the mounting nut.

Further preferably, an inner turntable is embedded at an upper end of the outer turntable, an upper end surface of the inner turntable is recessed downwards to form an arc-shaped groove; and the inner turntable is made of a silicone material with an integrated structure. The inner turntable is integrally made of silicone material, so that the cleaning liquid is completely separated from the support housing, which effectively avoids a direct contact between the geared motor and the cleaning liquid, prolongs the service life of the geared motor, reduces the requirement on the sealing performance of the support housing, thereby further improving the production efficiency.

Further preferably, cleaning bumps are laid on an upper surface of the inner turntable; cleaning bumps are made of silicone material; and cleaning bumps are arranged in the arc-shaped groove. The cleaning bumps form various textures on the upper surface of the inner turntable, so that the friction between the bristles of the cosmetic brush and the silicone inner turntable can be increased.

Preferably, the support housing is provided with a touch switch on an outer surface thereof. The touch switch is configured to control on and off of the geared motor. It is convenient for the user to operate.

Preferably, the base is adhered with a non-slip pad at a bottom thereof. It effectively prevents the cleaning device from toppling over due to vibration during working, and has a certain buffering effect, and can also prevent cleaning liquid from splashing due to overlarge vibration amplitude.

Beneficial Effects: the present disclosure simulates and motorizes the action of scrubbing back and forth between the bristles and the cleaning bumps on the upper surface of the inner turntable. Namely, the rotating shaft of the geared motor is driven to rotate by the touch switch, the rotating shaft of the geared motor drives the outer turntable to rotate. Since the inner turntable is embedded in the upper end surface of the outer turntable, the outer turntable drives the inner turntable to rotate, the cleaning efficiency is effectively improved. The cleaning bumps arranged on the upper surface of the inner turntable can effectively enhance the cleaning effect, and the motorization greatly reduces the cumbersome manual back-and-forth movement and improves the cleaning efficiency, and the time-consuming and laborious pain points of manually cleaning the cosmetic brush can be solved. In addition, the inner turntable is integrally made of silicone material, so that the cleaning liquid is completely separated from the support housing, which effectively avoids a direct contact between the geared motor and the cleaning liquid, prolongs the service life of the geared motor, reduces the requirement on the sealing performance of the support housing, thereby further improving the production efficiency.

In the figures: 1—support part; 2—cleaning part; 11—support housing; 12—base; 13—geared motor; 14—positioning and mounting ring; 15—mounting hole; 16—touch switch; 17—screw hole; 18—non-slip pad; 19—fixing screw; 21—outer turntable; 22—inner turntable; 23—cleaning bump; 24—mounting nut; 3—cleaner box; 31—cover; 32—cleaner; 33—body; 310—ventilation hole; 330—protrusion; 331—rim; 332—receiving portion.

DETAILED DESCRIPTION OF THE EMBODIMENTS

The present disclosure will now be described in further detail in combination with the accompanying drawings. These drawings are all simplified schematic views, and only illustrate the basic structure of the present disclosure in a schematic manner, so they only show the structures related to the present disclosure.

In the present disclosure, it should be noted that, the orientation or positional relationship indicated by the terms "upper", "lower", "inner", "outer", etc. is based on the orientation or positional relationship shown in the accompanying drawings, and is only for the convenience of describing the present disclosure and simplifying the description, rather than indicating or implying that the referred device or element must have a specific orientation, be constructed and operated in a specific orientation, and therefore should not be construed as a limitation of the present disclosure. In addition, unless otherwise expressly specified and limited, the terms "mounting" and "connection" should be understood in a broad sense, for example, it may be a fixed connection, a detachable connection, or an integral connection; or it may be a mechanical connection, or an electrical connection; or it may be in direct connection, or in indirect connection through an intermediate medium; or it may be a communication between two components. For those of ordinary skill in the art, the specific meanings of the above terms in the present invention can be appreciated according to specific situations.

Embodiment 1

Figure 1:
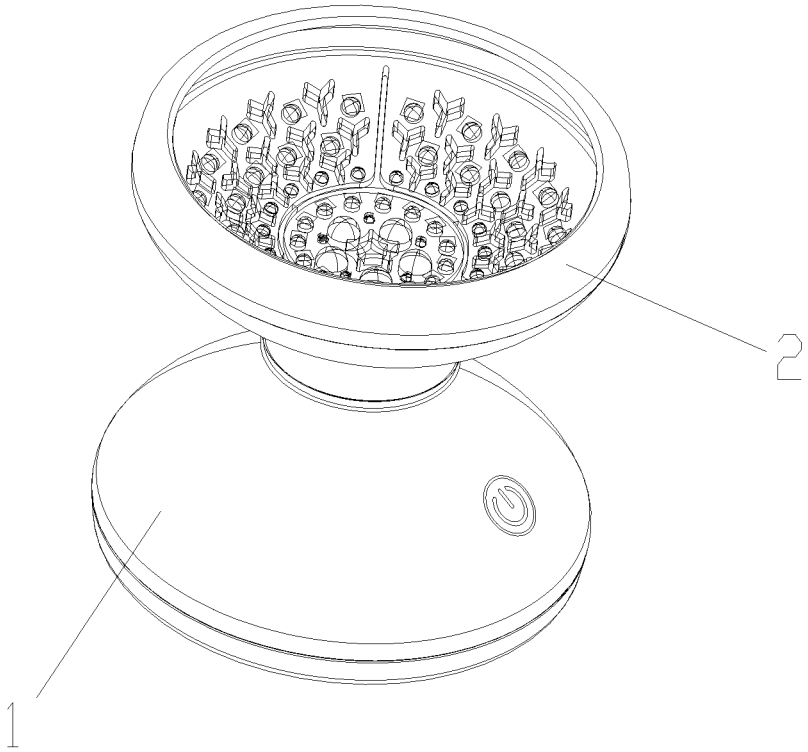
FIG. 1 is a schematic view of a cosmetic brush cleaning device according to an embodiment of the present disclosure.
Figure 2:
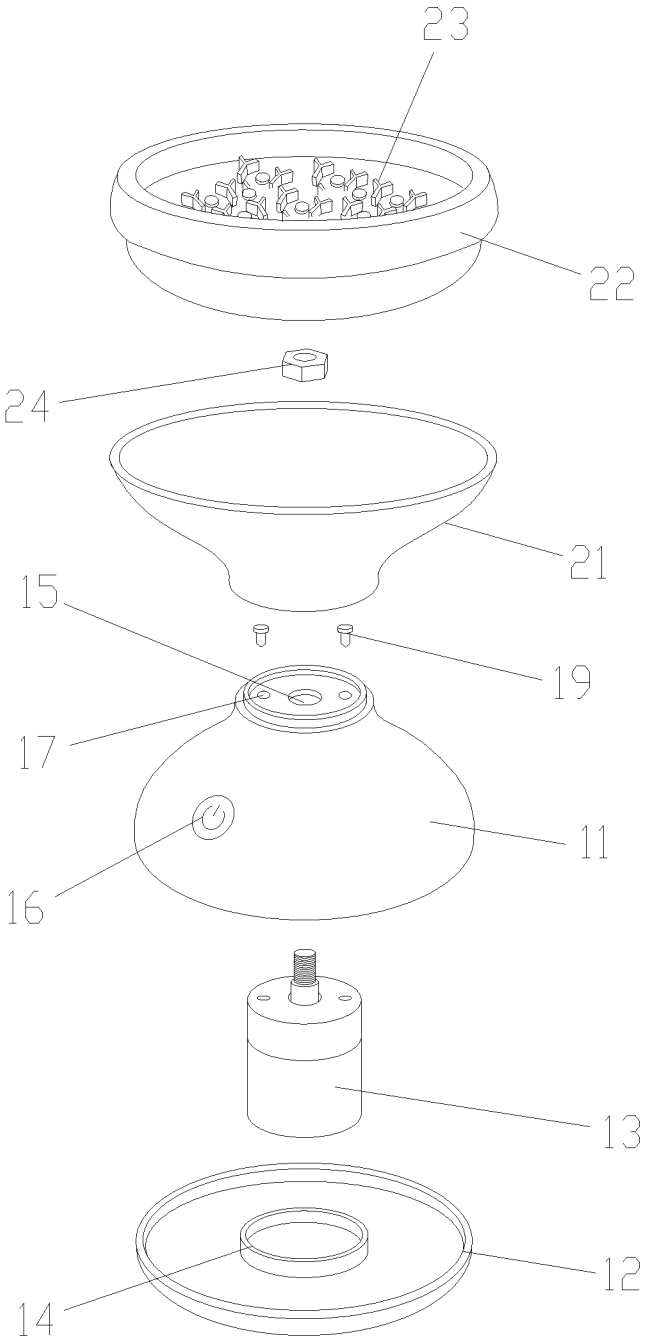
FIG. 2 is an exploded view of a cosmetic brush cleaning device according to an embodiment of the present disclosure.
Figure 3:
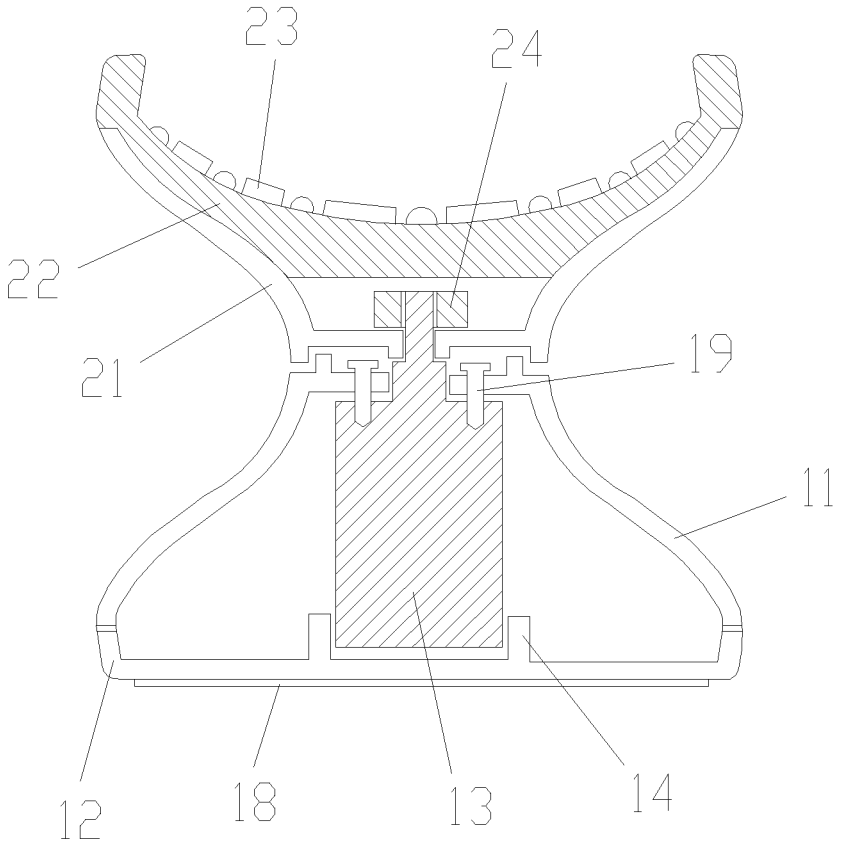
FIG. 3 is a cross-sectional view of a cosmetic brush cleaning device according to an embodiment of the present disclosure.

Referring to FIG. 1 to FIG. 3, the present disclosure provides a cosmetic brush cleaning device, including a support part 1 and a cleaning part 2. The support part 1 and the cleaning part 2 form an hourglass-shaped structure; and the cleaning part 2 is rotatably arranged on the top of the support part 1.

In this embodiment, the support part 1 includes a support housing 11. A base 12 is embedded in the bottom of the support housing 11. A positioning and mounting ring 14 is arranged on an upper end surface of the base 12. A speed reducing motor 13 is mounted in the positioning and mounting ring 14, so that the geared motor 13 can be conveniently positioned and mounted, thereby improving the production efficiency. The support housing 11 is provided with a mounting hole 15 and screw holes 17 at the top end thereof. The screw holes 17 are symmetrically arranged on two sides of the mounting hole 15. Fixing screws 19 are threadedly connected in the screw holes 17, so that the geared motor 13 can be fixed conveniently. The fixing screws 19 are in threaded connection with the geared motor 13 through the screw holes 17. A rotating shaft of the geared motor 13 extends out of the top end of the support housing 11 through the mounting hole 15. The support housing 11 is provided with a touch switch 16 on an outer surface thereof for controlling the on-off of the geared motor 13, which is convenient for a user to operate. The base 12 is adhered with non-slip pads 18 at the bottom thereof, which effectively prevents the cleaning device from toppling over due to vibration during working, and has a certain buffering effect, and can also prevent cleaning liquid from splashing due to overlarge vibration amplitude.

In this embodiment, the cleaning part 2 includes an outer turntable 21. A mounting nut 24 is arranged inside the outer turntable 21. The rotating shaft of the geared motor 13 extends through the bottom of the outer turntable 21, and the bottom of the outer turntable 21 is fixedly connected through the mounting nut 24. An inner turntable 22 is embedded at an upper end of the outer turntable 21. An upper end surface of the inner turntable 22 is recessed downwards to form an arc-shaped groove. The inner turntable 22 is made of a silicone material with an integrated structure. The inner turntable 22 is integrally made of silicone material, so that the cleaning liquid is completely separated from the support housing 11, which effectively avoids a direct contact between the geared motor 13 and the cleaning liquid, prolongs the service life of the geared motor 13, reduces the requirement on the sealing performance of the support housing 11, thereby further improving the production efficiency. Cleaning bumps 23 are laid on an upper surface of the inner turntable 22. The cleaning bumps 23 are made of silicone material. The cleaning bumps 23 are arranged in the arc-shaped groove, and the cleaning bumps 23 form various textures on the upper surface of the inner turntable 22, so that the friction between the bristles of the cosmetic brush and the silicone inner turntable can be increased.

Figure 4:
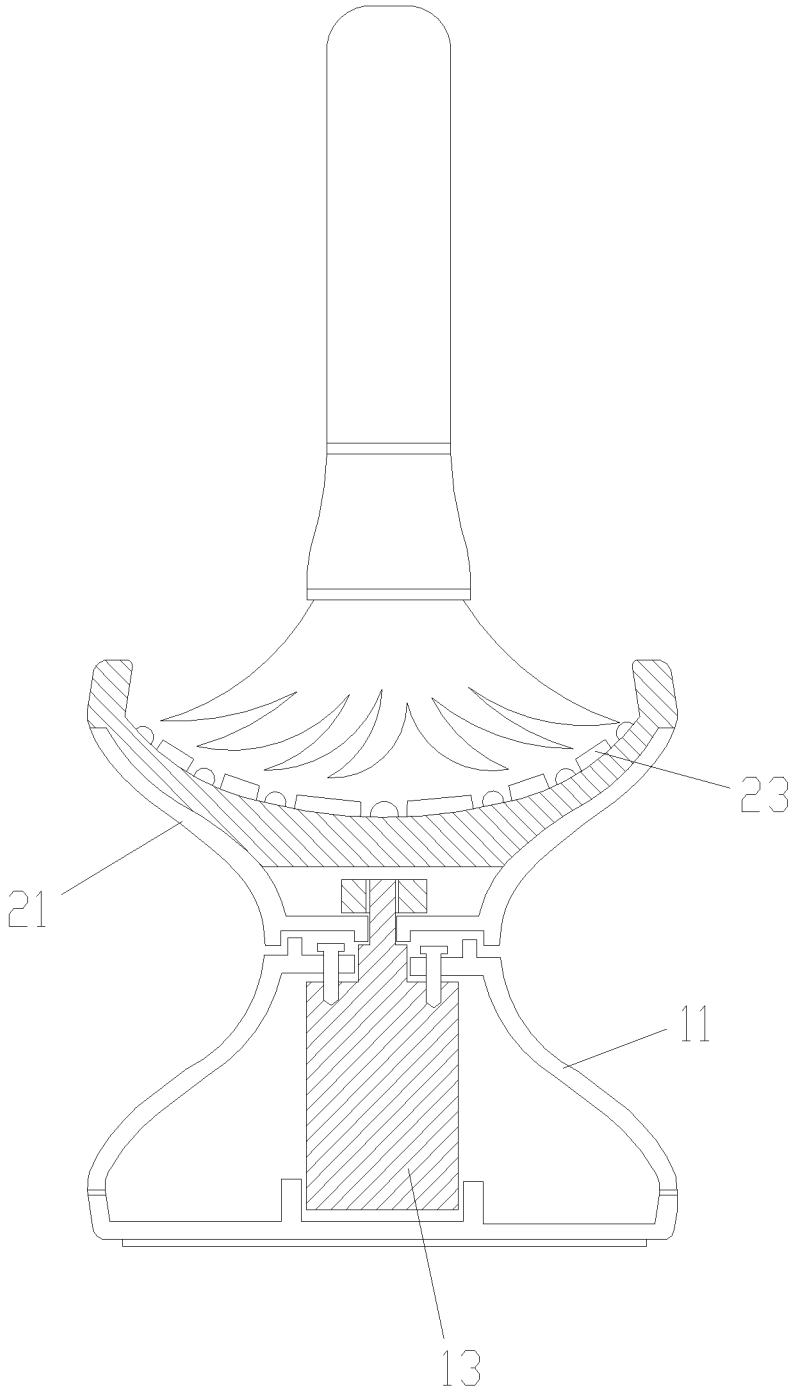
FIG. 4 is a working illustration of a cosmetic brush cleaning device according to an embodiment of the present disclosure.

The working principle is as follows. Referring to FIG. 4, the present disclosure simulates and motorizes the action of scrubbing back and forth between the bristles and the cleaning bumps 23 on the upper surface of the inner turntable 22. Namely, the rotating shaft of the geared motor 13 is driven to rotate by the touch switch 16, the rotating shaft of the geared motor 13 drives the outer turntable 21 to rotate. Since the inner turntable 22 is embedded in the upper end surface of the outer turntable 21, the outer turntable 21 drives the inner turntable 22 to rotate, the cleaning efficiency is effectively improved. The cleaning bumps 23 arranged on the upper surface of the inner turntable 22 can effectively enhance the cleaning effect, and the motorization greatly reduces the cumbersome manual back-and-forth movement and improves the cleaning efficiency, and the time consuming and laborious pain points of manually cleaning the cosmetic brush can be solved. In addition, the inner turntable 22 is integrally made of silicone material, so that the cleaning liquid is completely separated from the support housing 11, which effectively avoids a direct contact between the geared motor 13 and the cleaning liquid, prolongs the service life of the geared motor 13, reduces the requirement on the sealing performance of the support housing 11, thereby further improving the production efficiency.

Embodiment 2

Figure 5:
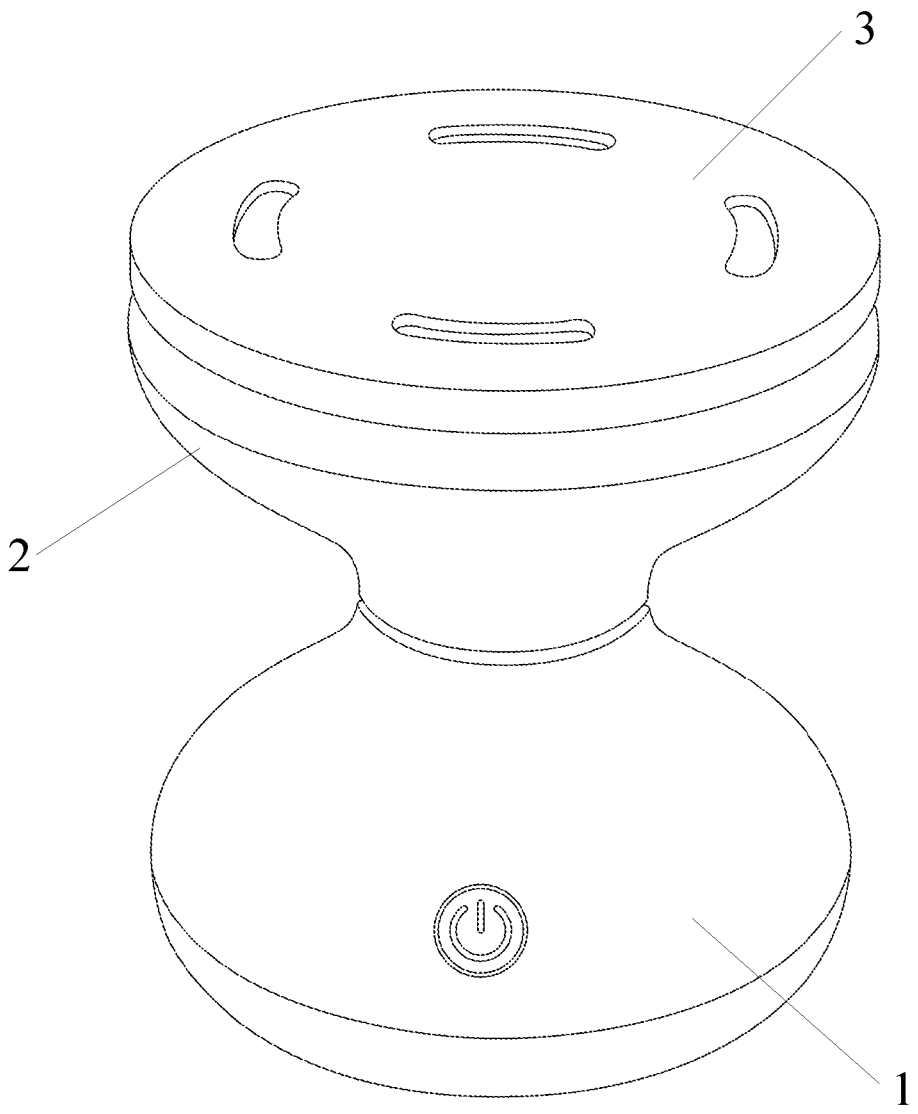
FIG. 5 is a schematic view of a cosmetic brush cleaning device according to another embodiment of the present disclosure.
Figure 6:
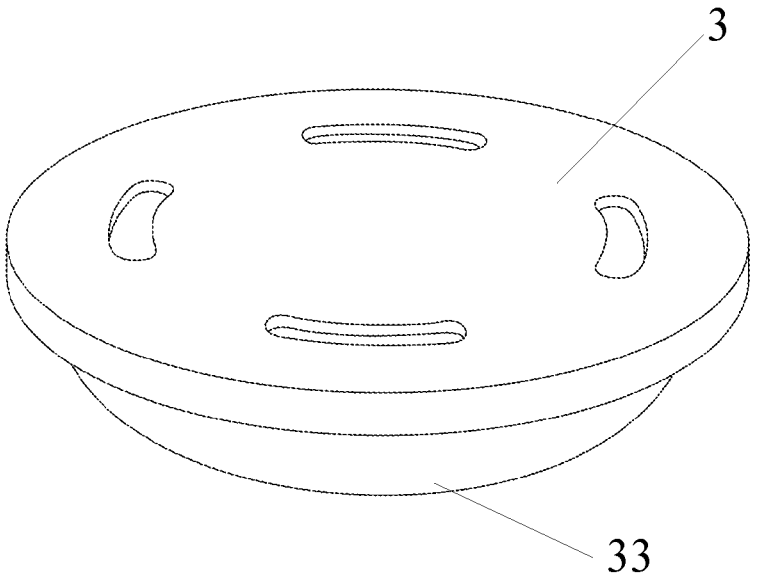
FIG. 6 is a schematic view of a cleaner box of the cosmetic brush cleaning device of FIG. 5.

FIG. 5 shows a cosmetic brush cleaning device according to another embodiment of the present disclosure. The cosmetic brush cleaning device includes a support part 1, a cleaning part 2, and a cleaner box 3. In this embodiment, the structures of the support part 1 and the cleaning part 2 are the same as those of the support part 1 and the cleaning part 2 of Embodiment 1, and thus are not described again. Referring also to FIG. 3, FIG. 5, and FIG. 6, the cleaner box 3 is embedded into the arc-shaped groove of the cleaning part 2.

Figure 7:
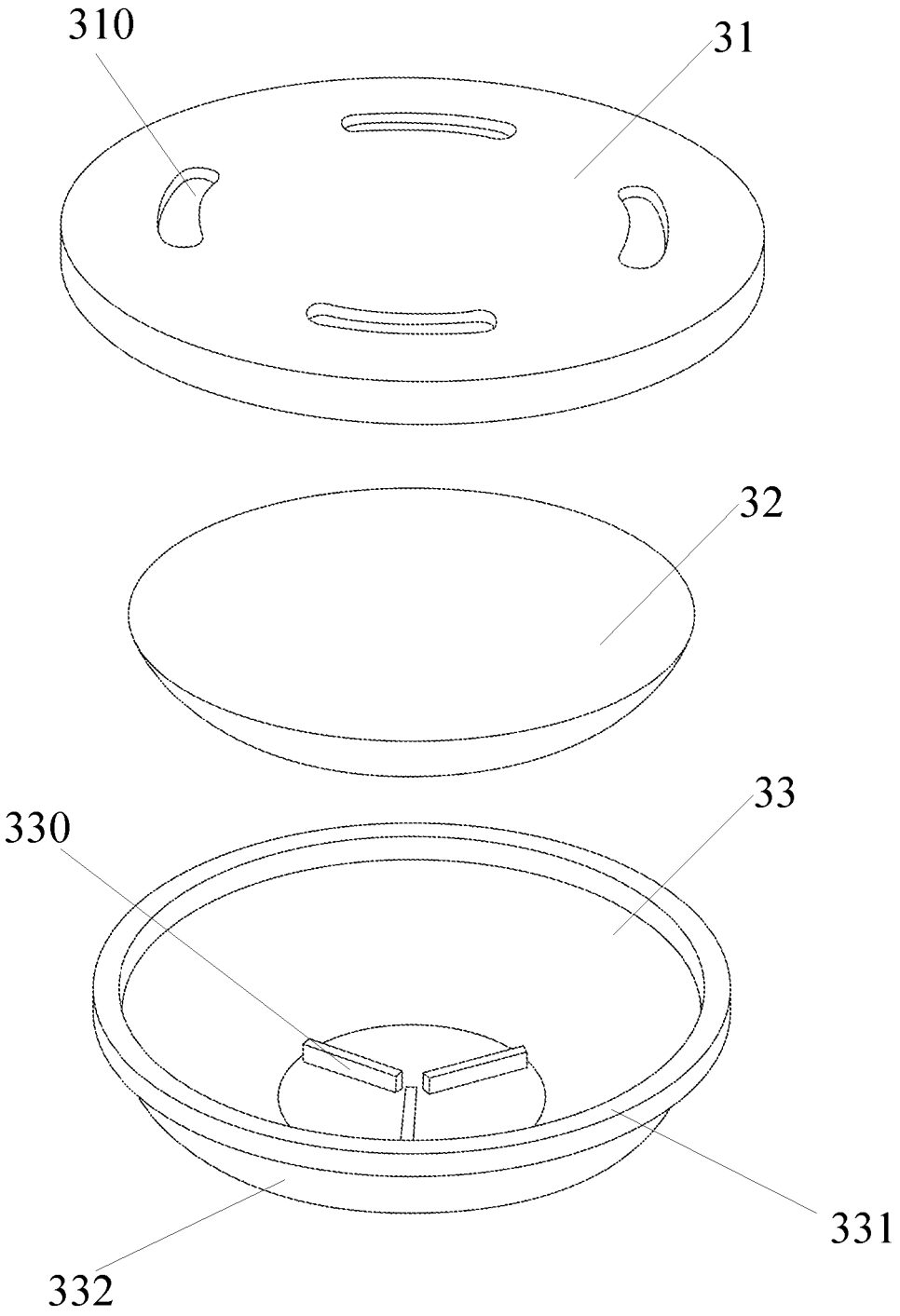
FIG. 7 is an exploded schematic view of the cleaner box of the cosmetic brush cleaning device of FIG. 5.

FIG. 6 and FIG. 7 show a specific structure of the cleaner box 3. The cleaner box 3 includes a cover 31 and a body 33, wherein the cover 31 is detachably connected to the body 33. Specifically, in this embodiment, the cover 31 is detachably connected to the body 33 through a threaded connection (not shown). Optionally, the cover 31 may also be connected to the body 33 by a snap connection, a magnetic attraction connection, or other detachable connection manner known in the art.

In this embodiment, the cover 3 is provided with four ventilation holes 310 extending through the cover 3. It should be acknowledged that, in other embodiments, any other suitable number of, such as one, two, or five, etc., ventilation holes may be provided, which is not limited by the present disclosure. The ventilation holes 310 help to promote evaporation of residual moisture on the solid cleaner and prevent the solid cleaner from softening due to prolonged contact with water, thereby reducing unnecessary consumption and waste of the solid cleaner. It should be acknowledged that in other embodiments, the cover 3 may not be provided with ventilation holes.

In this embodiment, three strip-shaped protrusions 330 are provided on an inner surface of the bottom of the body 33. The protrusions 330 serve to prevent the solid cleaner placed in the cleaner box 3 from slipping. It should be acknowledged that, in other embodiments, any other number of, such as one, two, five, etc., protrusions 330 may also be provided, which is not limited by the present disclosure. The shape of the protrusion 330 may also be any other suitable shape capable of playing a role of anti-slipping, such as a ring shape, a convex point, etc., which is not limited by the present disclosure.

Referring to FIG. 3 and FIG. 7, the body 33 includes a rim 331 and a receiving portion 332. A maximum radial dimension of the receiving portion 332 is slightly greater than a maximum radial dimension of the arc-shaped groove of the cleaning part 2, and a maximum axial dimension of the receiving portion 332 is less than a maximum axial dimension of the arc-shaped groove of the cleaning part 2. Thus, in a radial direction, the receiving portion 332 and the arc-shaped groove of the cleaning part 2 are in interference fit; in an axial direction, the receiving portion 332 can be accommodated in the arc-shaped groove of the cleaning part 2 without contacting with the inside of the arc-shaped groove of the cleaning part 2. An outer diameter of the rim 331 is greater than or equal to an outer diameter of the top of the cleaning part 2. Thus, the rim 331 can be pressed against a surface of the top of the cleaning part 2. In use, the cleaner box 3 can be received in the arc-shaped groove of the cleaning part 2 only by placing the cleaner box 3 above the arc-shaped groove of the cleaning part 2 and pressing the cleaner box 3 downward. Since the inner turntable 22 is made of soft material such as silicone material, and the receiving portion 332 and the arc-shaped groove of the cleaning part 2 are in interference fit in the radial direction, there will be a certain contact between the body 33 and an inner wall of the inner turntable 22 in the radial direction during a process of embedding the cleaner box 3 into the arc-shaped groove of the cleaning part 2, so that the cleaner box 3 is stuck in the arc-shaped groove of the cleaning part 2. It should be acknowledged that, in other embodiments, the maximum radial dimension of the receiving portion 332 may also be equal to or less than the maximum radial dimension of the arc-shaped groove of the cleaning part 2, so long as the receiving portion 332 can be received in the arc-shaped groove of the cleaning part 2 in the radial direction. FIG. 7 also shows a cleaner 32. In this embodiment, the cleaner 32 is a solid cleaner such as soap, lumps for laundry, etc. In other embodiments, the cleaner 32 may also be a liquid cleaner, which is not limited in the present disclosure. In this embodiment, the cleaner box 3 is embedded into the arc-shaped groove of the cleaning part 2, so that a space for carrying the cleaner is increased for the cosmetic brush cleaning device without increasing the volume of the cosmetic brush cleaning device, the convenience of the cosmetic brush cleaning device is further improved, and it is particularly convenient for a user to carry the cosmetic brush cleaning device when the user goes out for travel.

The basic principles and the main features of the present disclosure and the advantages of the present disclosure have been shown and described above, it will be apparent to those skilled in the art that the present disclosure is not limited to the details of the foregoing illustrative embodiments, and that the present disclosure may be implemented in other specific forms without departing from the spirit or essential characteristics thereof. The core claim of the present disclosure is to protect the mechanical principle of motorizing the cleaning part, not the texture structure of the inner turntable, and as long as the mechanical principle is adopted, no matter how the texture structure of the inner turntable is changed, the corresponding protection scope should be included. The embodiments are therefore to be considered in all respects as illustrative and not restrictive, the scope of the present disclosure is defined by the appended claims rather than by the foregoing description, and all changes which are fallen within the meaning and range of equivalency of the claims are therefore intended to be embraced in the present disclosure. Any reference sign in claims should not be construed as limiting the claim concerned.

In addition, it should be understood that, although this specification is described in terms of embodiments, not every embodiment only includes an independent technical solution, and this description in the specification is only for the sake of clarity. Those skilled in the art should take the specification as a whole, and the technical solutions in each embodiment can also be appropriately combined to form other embodiments that can be understood by those skilled in the art.

The invention claimed is:

1. A cosmetic brush cleaning device, comprising:

a support part formed in a shape of a first inverted bowl having a first tapering diameter and provided with a geared motor, a rotating shaft of the gear motor extending out of a top end of the support part; and a cleaning part formed in a shape of a second inverted bowl having a second tapering diameter, rotatably arranged at a top of the support part and fixedly connected to the rotating shaft, wherein the cleaning part comprises an outer turntable and an inner turntable, the inner turntable is embedded in the outer turntable, an upper end surface of the inner turntable is recessed downwards to form an arc-shaped groove, and the inner turntable is a one-piece structure without any through holes, so that the arc-shaped groove is completely separated from the support part, wherein cleaning bumps are laid on an upper surface of the arc-shaped groove, and the cleaning bumps are arranged in the arc-shaped groove, wherein an end of the support part having the first tapering diameter is connected to an end of the cleaning part having the second tapering diameter, so that the support part and the cleaning part form an hourglass-shaped structure, and the cleaning part is rotatably arranged at a top of the support part.

2. The cosmetic brush cleaning device of claim 1, wherein the support part comprises a support housing; a base is embedded in a bottom of the support housing.

3. The cosmetic brush cleaning device of claim 2, wherein the base is provided with a positioning and mounting ring on an upper end surface thereof; and the geared motor is mounted in the positioning and mounting ring.

4. The cosmetic brush cleaning device of claim 3, wherein the support housing is provided with a mounting hole and screw holes at a top end thereof; the screw holes are symmetrically arranged on two sides of the mounting hole; and fixing screws are threadedly connected in the screw holes.

5. The cosmetic brush cleaning device of claim 4, wherein the fixing screws are in threaded connection with the geared motor through the screw holes, the rotating shaft of the geared motor extends out of the top end of the support housing through the mounting hole.

6. The cosmetic brush cleaning device of claim 2, wherein the support housing is provided with a touch switch on an outer surface thereof, and the touch switch is configured to control on and off of a geared motor.

7. The cosmetic brush cleaning device of claim 2, wherein the base is adhered with a non-slip pad at a bottom thereof.

8. The cosmetic brush cleaning device of claim 1, wherein a mounting nut is provided inside the outer turntable; and the rotating shaft of the geared motor extends through a bottom of the outer turntable, and the bottom of the outer turntable is fixedly connected through the mounting nut.

9. The cosmetic brush cleaning device of claim 1, wherein, the cleaning bumps are made of silicone material.

10. The cosmetic brush cleaning device of claim 1, further comprising a cleaner box, wherein the cleaner box comprises a body and a cover detachably connected to the body, the body comprises a receiving portion and a rim arranged at an upper portion of the receiving portion.

11. The cosmetic brush cleaning device of claim 10, wherein the cover is provided with at least one ventilation hole extending through the cover.

12. The cosmetic brush cleaning device of claim 10, wherein at least one non-slip protrusion is provided on an inner surface of the receiving portion.

13. The cosmetic brush cleaning device of claim 10, wherein an outer diameter of the rim is greater than or equal to an outer diameter of a top of the cleaning part; the rim is pressed against an upper surface of the top of the cleaning part when the cleaner box is embedded inside the cleaning part.

* * * * *